US005198792A

United States Patent [19]

Bacon et al.

[11] Patent Number: 5,198,792

[45] Date of Patent: Mar. 30, 1993

[54] ELECTRICAL FUSES AND METHOD OF MANUFACTURE

[75] Inventors: Martin D. Bacon; Peter J. Drayton; Rognvald R. Peterson, all of Frome, England

[73] Assignee: Cooper Industries, Inc., Houston, Tex.

[21] Appl. No.: 898,054

[22] Filed: Jun. 12, 1992

[51] Int. Cl.[5] ..... H01H 85/143; H01R 43/00

[52] U.S. Cl. ..... 337/251; 337/248; 29/623; 29/854; 228/175; 228/179; 228/180.1

[58] Field of Search ..... 337/227, 228, 248, 251, 337/252; 29/619, 621, 623, 854, 879; 228/175, 179, 180.1

[56] References Cited

U.S. PATENT DOCUMENTS 3,983,525 9/1976 Healey, Jr. ..... 337/186
4,010,440 3/1977 Wellard ..... 29/619
4,161,714 7/1979 Jacobs, Jr. ..... 337/251
4,414,526 11/1983 Panaro ..... 337/163
4,746,784 5/1988 Vermij ..... 29/623

FOREIGN PATENT DOCUMENTS 684640 9/1979 U.S.S.R. ..... 29/623

*Primary Examiner*—P. W. Echols
*Attorney, Agent, or Firm*—William Bruce Patterson; Nelson A. Blish; Alan R. Thiele

[57] ABSTRACT

A miniature electrical fuse has electrical lead wires (8) to permit the fuse to be connected into a circuit without use of a fuse holder. Wires (8) are resistance welded to electrically conductive end caps (4) closing off the end of a non-conductive tubular housing (3) containing a fusible element (1). Element (1) is connected to the caps (4) by solder joints (7) and caps (4) are connected to housing (3) by solder joints (6). The solder is a lead/tin alloy of high melting point. The end walls of the caps (4) are comparatively thick in relation to their side walls in the range 1.3 to 1 and 2.1 to 1.

13 Claims, 1 Drawing Sheet

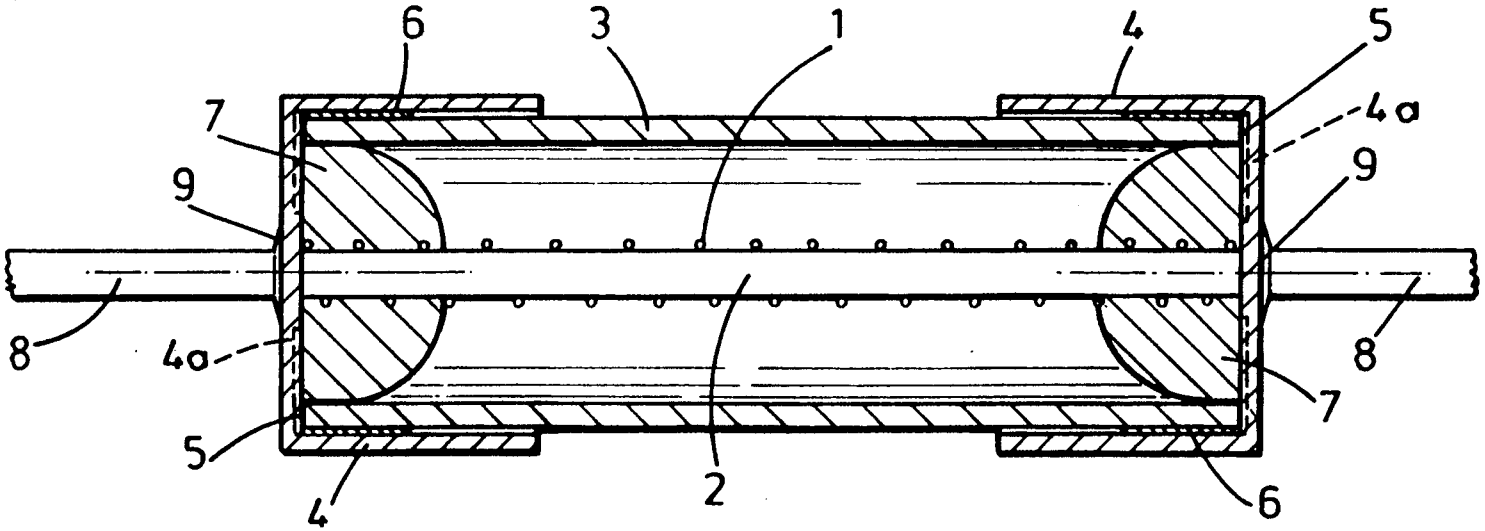
5
4a
9
8
7
6
4
1
2
3
6
4
7
9
4a
5
8

ELECTRICAL FUSES AND METHOD OF MANUFACTURE

The present invention relates to miniature electrical fuses and more particularly to such fuses in which the fusible element is located within a tubular housing of an insulating material and connected between electrically conducting end caps which close off the opposite ends of the tubular housing and have electrical lead wires connected thereto to permit the fuse to be connected into a circuit without use of a fuse holder.

The invention is particularly concerned with problems arising from securing the electrical wires to the end caps in miniature fuses In known constructions the lead wires are generally welded or staked to external or secondary caps which are pushed on over the main end caps after manufacture of the main body of the fuse. This is because attempts to resistance weld lead wires directly to the main end caps give rise to a number of problems. Particular problems which occur are weakness of the lead attachment; distortion of the fusible element during welding which causes variation in the blowing characteristics of the fuse or loss of breaking capacity; and furthermore movement of solder fluidized during the welding process causes globules or streamers of solder to enter the fuse housing and affect the fuse performance.

It is an object of the present invention to provide a fuse construction and method of manufacture which is sufficiently robust to withstand the forces and thermal effects involved in resistance welding axial lead wires directly to the end caps of a fuse and in which the aforementioned problems are substantially reduced or avoided.

Accordingly, from one aspect, the invention provides a method of manufacturing a miniature electrical fuse having a fusible element located within a tubular housing made of insulating material, the element being connected between electrically conducting end caps which close off the opposite ends of the housing, and the end caps having electrical lead wires connected thereto to permit the fuse to be connected into a circuit without use of a fuse holder, said method comprising forming a sub-assembly by uniting each end of the tubular housing, and the element to the end caps with a solder alloy while maintaining an axial force on each end cap to urge each end cap into direct mechanical contact with the pertaining end face of the housing such that solder is substantially absent from the site of said direct mechanical contact, and, subsequently to the solder having solidified, simultaneously resistance welding the lead wires directly to the end caps of the sub assembly using opposed thrust forces which via the end caps are transmitted through the said direct mechanical contacts to the tubular housing, wherein the end caps are selected to have comparatively thick base portions and thin side walls, the thickness ratio being within the range 1.3 to 1 and 2.1 to 1, and the solder alloy is selected to have a comparatively high melting point, in excess of 180° C., whereby the sub-assembly is sufficiently robust to withstand the forces involved in the resistance welding process, the side walls of the end caps are sufficiently thin and elastic not to damage the housing when they contract in the solder cooling phase after the caps are soldered to the housing, the solder is of sufficiently high melting point to prevent displacement of the fusible element or the solder joints of the sub-assembly during the resistance welding process, and the end faces of the housing are accurately plane parallel and orthogonal to the axis of the housing.

The invention also relates to constructional features of the fuse and according to a further aspect therefore the invention provides a miniature electrical fuse in which the fusible element is located within a tubular housing of a insulating material and connected between electrically conducting end caps which close off the opposite ends of the tubular housing wherein an electrical lead wire is secured to each end cap and the thickness of at least that part of the base of each end cap to which a lead wire is secured is greater than the thickness of the side wall of the cap in a ratio between 1.3 and 2.1 to 1.

The invention will now be further described by way of example, with reference to the accompanying drawing which is an axial view partly in section and to an enlarged scale of one embodiment of fuse according to the invention.

Referring to the drawing, a fusible element comprising a helical wire 1 wound on an insulating support 2 is axially located in a cylindrical tubular glass housing 3 whose ends are closed off by electrically conducting metal end caps 4. The housing 3 could alternatively be made of ceramic or a filled plastic material and the fusible element 1 could alternatively be a slant wire, an axial wire, or other element design known in the art. If desired the housing 3 may be filled with a suitable material e.g. quartz grains, ceramic particles, ceramic wool, ceramic cloth, ceramic paper, polymer granules, inorganic or organic materials intended to release arc-quenching substances when heated, or solid matrix ceramic materials.

The ends of the tubular housing 3 are made accurately plane parallel and perpendicular to the axis of the housing so that when the solder initially located within each end cap 4 is melted and the end cap is pushed on to the housing 3 during the assembly of the fuse, direct mechanical contact is achieved between the end cap and the end faces of the housing as shown at 5. In the case of a glass tube this accuracy of the tube end faces can be achieved by cutting with a diamond wheel. In the case of a ceramic tube this can be achieved by end grinding after firing.

A flux is used initially to melt the solder into the caps 4 prior to assembly of the fuse, but after solder solidification and prior to such assembly the flux is removed by immersion in a solvent. This ensures that the assembled fuse has a solid metal joint between the end cap and the end faces of the tubular housing, without enclosures of solidified flux. Such enclosures of flux can lead to distortion of the fuse during the subsequent resistance welding process as the enclosures soften at comparatively low temperatures.

During the assembly process of the fuse when the solder is heated and the end caps 4 are pushed onto the housing 3, force is maintained on the ends caps 4 throughout the solder cooling process to ensure that the direct mechanical contact with the ends of the tubular housing is retained. The resulting solder joint between the housing 3 and the side wall of the end caps is shown at 6 and the solder joint to the fuse wire is shown at 7. Solder is substantially squeezed out from and therefore is effectively absent from the site 5 of direct mechanical contact between housing 3 and end caps 4.

To facilitate the subsequent resistance welding process after the solder has cooled and solidified, the solder is selected to have a comparatively high melting point (for example 180° C. or greater) and preferably is an alloy of lead in the range 77–90% and tin in the range 23%–10%. One particular alloy which is suitable is 85% lead and 15% tin. Other alloys containing tin, lead, possibly with antimony and silver in varying proportions, may also be utilized.

Such an initial construction enables the fuse to withstand the forces and thermal effects involved in the subsequent resistance welding of the axial lead wires 8 directly to the end caps 4, the welds being shown at 9.

As can be seen, the base of each end cap 4 is thicker than the side wall of the cap preferably within the ratio 1.3 to 1 and 2.1 to 1. The thick base of the end caps is provided to withstand the subsequent resistance welding process whereas the side wall of the end caps is comparatively thin and elastic so that during the solder cooling process the contraction of the side wall and solder joint 6 does not lead to excessive forces on the frangible side walls of the housing 3. For a fuse having a cylindrical tubular housing of approximately 5 mm external diameter and an overall length of 15 to 24 mm the thickness of the base of each end cap is typically 0.5 to 0.72 mm and the side wall thickness is typically 0.3 to 0.45 mm. The lead wires may be between 0.4 and 1.0 mm in diameter and made of tin plated copper or tin plated copper clad steel.

To effect resistance welding of the lead wires 8 to the end caps 4 a clamp type electrode is simultaneously fitted to the side wall of each end cap 4 and each lead wire 8 is gripped by an electrode and urged axially into engagement with the pertaining end cap to form the welds 9. Thus the opposing axial forces from both lead wires 8 are transmitted by the comparatively thick end walls of the end caps 4 and their circumferential abutment with the end faces of the housing 3 to the housing itself. The thermal effects of the resistance welding process are greatest at the outermost surface of the end walls of the end caps 4 where the welds 9 are formed. Thus the thermal effects are comparatively remote from the solder joints 6,7 and because the solder is of high melting point it does not soften. The lead wires 8 are therefore simultaneously fitted directly to the end caps 4 without disturbing the pre-assembled main portion of the fuse.

While a particular embodiment has been described it will be understood that various modifications may be made without departing from the scope of the invention. For example only the central area of the base of each end cap to which the lead wire 8 is attached may be of increased thickness as indicated by the broken line configuration 4*a*. Typically in this case the central portion to which the lead wire is welded may be of thickness between 0.5 and 1.0 mm.

We claim:

1. A method of manufacturing a miniature electrical fuse having a fusible element located within a tubular housing made of insulating material, the element being connected between electrically conducting end caps which close off the opposite ends of the housing, and the end caps having electrical lead wires connected thereto to permit the fuse to be connected into a circuit without use of a fuse holder, said method comprising, forming a sub-assembly by uniting each end of the tubular housing and the element to the end caps with a solder alloy while maintaining an axial force on each end cap to urge each end cap into direct mechanical contact with the pertaining end face of the housing such that solder is substantially absent from the site of said direct mechanical contact, and, subsequently to the solder having solidified, simultaneously resistance welding the lead wires directly to the end caps of the sub-assembly using opposed thrust forces which via the end caps are transmitted through the said direct mechanical contacts to the tubular housing, wherein the end caps are selected to have comparatively thick base portions and thin side walls, the thickness ratio being within the range 1.3 to 1 and 2.1 to 1, and the solder alloy is selected to have a comparatively high melting point, in excess of 180° C., whereby the sub-assembly is sufficiently robust to withstand the forces involved in the resistance welding process, the side walls of the end caps are sufficiently thin and elastic not to damage the housing when they contract in the solder cooling phase after the caps are soldered to the housing, the solder is of sufficiently high melting point to prevent displacement of the fusible element or the solder joints of the sub-assembly during the resistance welding process, and the end faces of the housing are accurately plan-parallel and orthogonal to the axis of the housing.

2. The method claimed in claim 1, wherein prior to formation of said sub-assembly each end cap is loaded with solder alloy in the presence of a flux and after solder solidification the flux is removed by immersion in a solvent to prevent inclusions of solidified flux in the solder joints of the sub-assembly.

3. The method claimed in claim 2, wherein the solder alloy is a composition of between 77 and 90% lead with the remainder being tin.

4. The method claimed in claim 4, wherein the tubular housing is made of glass and the end faces are rendered accurately plane parallel and orthogonal to the axis of the housing by cutting with a diamond wheel.

5. The method claimed in claim 2, wherein the tubular housing is made of glass and the end faces are rendered accurately plane parallel and orthogonal to the axis of the housing by cutting with a diamond wheel.

6. The method claimed in claim 2, wherein the tubular housing is made of ceramic and the end faces are reduced accurately plane parallel and orthogonal to the axis of the housing by end grinding after firing.

7. The method claimed in claim 1, wherein the solder alloy is a composition of between 77 and 90% lead with the remainder being tin.

8. The method claimed in claim 7, wherein the tubular housing is made of glass and the end faces are rendered accurately plane parallel and orthogonal to the axis of the housing by cutting with a diamond wheel.

9. The method claimed in claim 7, wherein the tubular housing is made of ceramic and the end faces are reduced accurately plane parallel and orthogonal to the axis of the housing by end grinding after firing.

10. The method claimed in claim 1, wherein the tubular housing is made of glass and the end faces are rendered accurately plane parallel and orthogonal tot he axis of the housing by cutting with a diamond wheel.

11. The method claimed in claim 1, wherein the tubular housing is made of ceramic and the end faces are reduced accurately plane parallel and orthogonal to the axis of the housing by end grinding after firing.

12. A miniature electrical fuse when manufactured by the method of claim 1.

13. A miniature electrical fuse comprising a fusible element (1) located within a tubular housing (3) made of insulating material and connected between electrically conducting end caps (4) which close off the opposite ends of the housing (3), and an electrical lead wire (8) is secured to each end cap (4), wherein the thickness of that part of the base of each end cap (4) to which a lead wire (8) is secured is greater than the thickness of the side wall of the cap (4) in a ratio between 1.3 to 1 and 2.1 to 1.

* * * * *